US006601829B2

(12) United States Patent
Graham

(10) Patent No.: US 6,601,829 B2
(45) Date of Patent: Aug. 5, 2003

(54) PULLEY SYSTEM WITH GRIPPING BLOCK AND TACKLE FOR LOAD HANDLING

(76) Inventor: Bryan Paul Graham, 3205 Cascade Trail SE., Rio Rancho, NM (US) 87124

( * ) Notice: Subject to any disclaimer, the term of this patent is extended or adjusted under 35 U.S.C. 154(b) by 56 days.

(21) Appl. No.: 10/001,339

(22) Filed: Nov. 23, 2001

(65) Prior Publication Data

US 2002/0100900 A1 Aug. 1, 2002

Related U.S. Application Data

(60) Provisional application No. 60/253,005, filed on Nov. 27, 2000.

(51) Int. Cl.[7] ..... B66D 3/04

(52) U.S. Cl. ..... 254/391; 254/394; 254/399; 254/408

(58) Field of Search ..... 254/268, 269, 254/271, 394, 391, 396, 398, 399, 408, 409

(56) References Cited

U.S. PATENT DOCUMENTS 723,231 A * 9/1903 Benedict ..... 254/391
756,747 A * 4/1904 Walton ..... 254/408
801,328 A * 10/1905 Miller ..... 254/401
811,440 A * 1/1906 Roberts ..... 188/64
848,905 A * 4/1907 Jenson ..... 254/391
903,433 A * 11/1908 Baker ..... 188/65.1
1,014,728 A * 1/1912 Tabulo ..... 188/174
1,636,273 A * 7/1927 Baker ..... 254/391
1,764,512 A * 6/1930 Hume ..... 254/391
1,890,992 A * 12/1932 Janssen ..... 188/65.1
1,971,511 A * 8/1934 Stahi ..... 254/391
2,343,086 A * 2/1944 Schultz ..... 254/391
2,463,394 A * 3/1949 King ..... 254/337
3,112,816 A * 12/1963 Halford ..... 254/391
3,759,346 A * 9/1973 Brda ..... 182/7
4,213,019 A * 7/1980 Houp ..... 200/61.13
4,850,571 A * 7/1989 Cabanos ..... 254/392
4,934,660 A * 6/1990 Nelson ..... 254/394
5,615,865 A * 4/1997 Fountain ..... 254/391
5,951,444 A * 9/1999 Webber ..... 482/99
6,234,454 B1 * 5/2001 Vassioukevitch ..... 254/391

* cited by examiner

*Primary Examiner*—Emmanuel Marcelo

(57) ABSTRACT

An improved block and tackle system comprising a stationary-block housing (10) having attached pulleys (14 & 18) and cam cleat (22), and a moving-block housing (12) with attached pulley (16) and cam cleat (20) Said invention allows a load (8) to be raised, moved, or lowered with a minimal amount of rope (6).

1 Claim, 1 Drawing Sheet

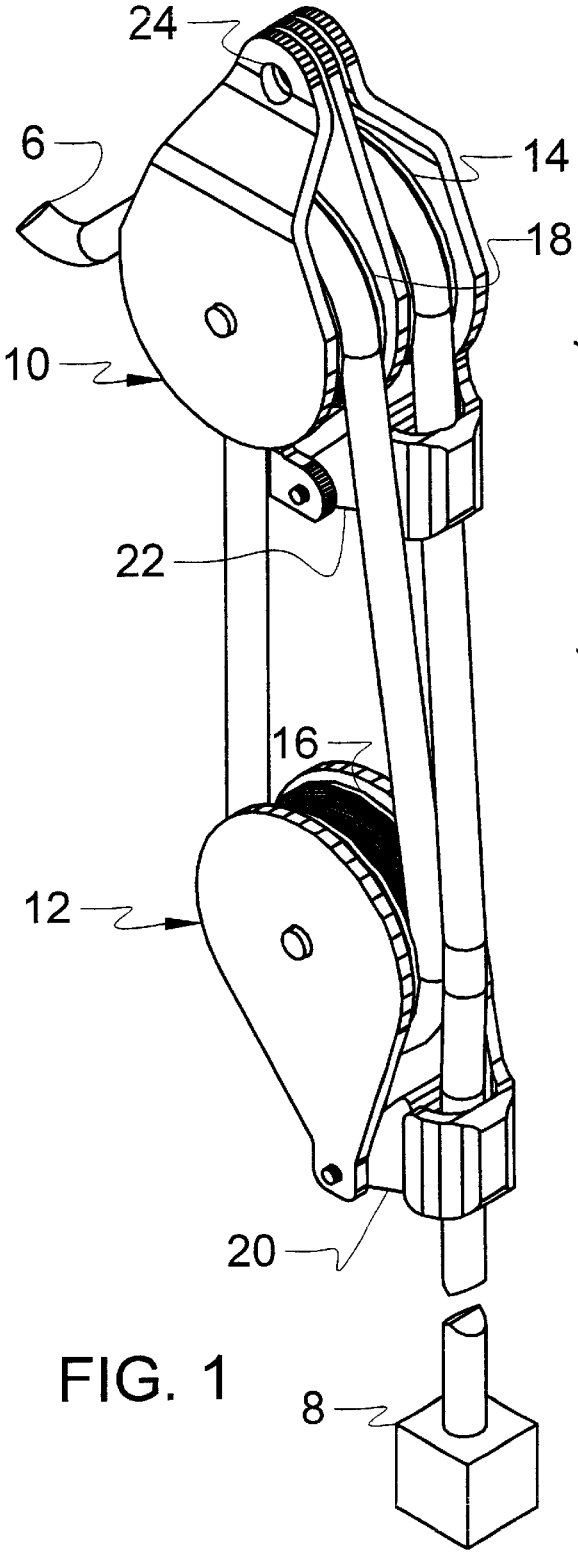
FIG. 1
FIG. 2
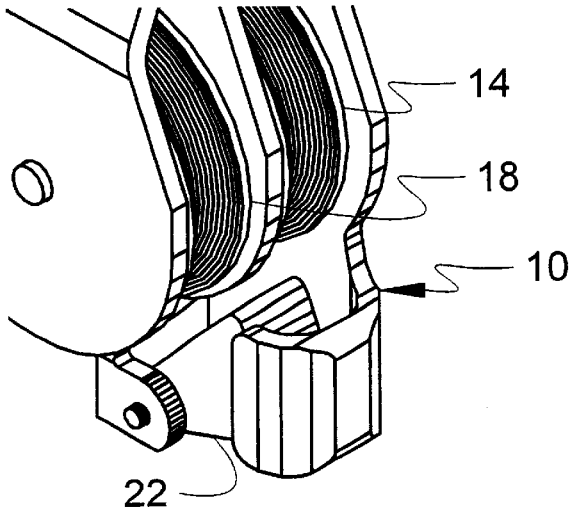
FIG. 3
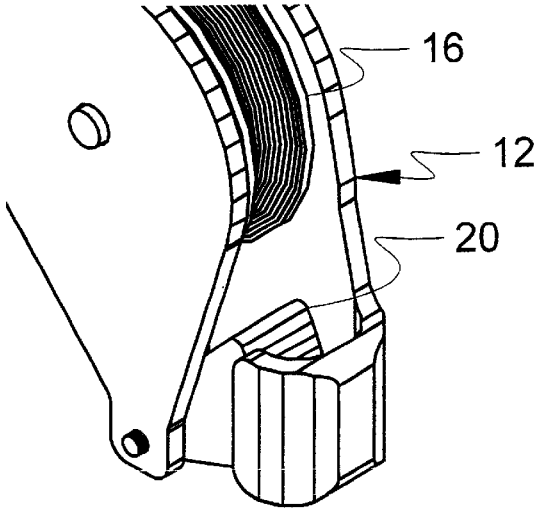

PULLEY SYSTEM WITH GRIPPING BLOCK AND TACKLE FOR LOAD HANDLING

CROSS-REFERENCE TO RELATED APPLICATION

This application claims the benefit of Provisional Patent Application Ser. No. 60/253,005 filed Nov. 27, 2000.

FEDERALLY SPONSORED RESEARCH

Not applicable

SEQUENCE LISTING OF PROGRAM

Not applicable

BACKGROUND—FIELD OF INVENTION

This invention relates to load handling systems, specifically to block and tackle pulley arrangements.

BACKGROUND—DISCUSSION OF PRIOR ART

Block and tackle pulley arrangements are commonly used to provide a mechanical advantage in raising, lowering, and moving loads. Typically, these arrangements involve the passing of a cord, rope, or cable through two sets of pulleys set in housings (blocks,) one of which (the fixed block) is attached to an immobile point such as a crane, tripod, or other fixed component. The second (or moving) block is typically directly attached to the load involved. By pulling on the rope, a mechanical advantage (determined by the number of pulleys utilized) is applied to move the load.

In the typical current embodiment, the limitation of this system is that by fixing the moving block to the load itself, the length of rope required to move the load is determined by multiplying the distance from the load to the fixed block by the ratio of mechanical advantage to be applied. That is, if a load is 100 feet from the fixed block, and a mechanical advantage of 3:1 is applied by threading a rope three times through three different pulleys, then 300 feet of rope is required to make the system operate.

Although in certain industrial applications, this limitation is commonly overcome through the use of longer ropes or cables, there are many applications where this limitation is difficult to overcome. Such applications include, but are not limited to, rock climbing, mountaineering, high angle or confined space rescue, small-craft marine applications, and logging or other backcountry load handling situations. These applications are typically limited with regard to weight or logistics to the lengths of rope that can be applied to handling loads.

Another ramification of pulley systems requiring long lengths of rope to operate is replacement costs for rope. Ropes in pulley systems currently in use for rescue applications are typically replaced on a regular basis regardless of wear or amount of use. Pulley systems that require a large amount of rope incur an increased cost, related to the replacement of the rope, over the lifetime of the system.

Another embodiment that is in current use is the 'inchworm' or the piggy-backed z-pulley system. Both of these systems use multiple pulleys and a set of rope-grabs (or climbing ascenders) to generate mechanical advantage while minimizing the amount of rope that is required. The major disadvantage of this type of hauling system is the need for multiple anchor points for each of these pieces of equipment and a greatly increased complexity of rigging. These types of systems are typically very time consuming and complex to set up.

Various other disclosures of rope or clamps in combination with pulleys are shown in the following references:

| | | |
|---|---|---|
| U.S. Pat. No. | 723,231 | Benedict |
| U.S. Pat. No. | 811,440 | Roberts |
| U.S. Pat. No. | 848,905 | Jenson |
| U.S. Pat. No. | 903,433 | Baker |
| U.S. Pat. No. | 1,636,273 | Baker |
| U.S. Pat. No. | 1,764,512 | Hume |
| U.S. Pat. No. | 1,971,511 | Stahl |
| U.S. Pat. No. | 3,759,346 | Brda. |
| U.S. Pat. No. | 4,213,019 | Houp |
| U.S. Pat. No. | 4,934,660 | Nelson |
| U.S. Pat. No. | 5,615,865 | Fountain |

None of the foregoing references are structurally similar the device of the present invention or accomplish the end goals in the same manner nor as efficiently, as each of these refer to pulley systems in which the moving block housing is directly attached to the load.

OBJECTS AND ADVANTAGES

Accordingly, several objects and advantages of the present invention are:

a. to provide a block and tackle pulley system that applies equivalent mechanical advantage in moving a load as the prior art;

b. to provide a weight and space-efficient block and tackle pulley system that can be used in man-packed, confined-space situations, or weight-critical situations;

c. to provide a block and tackle pulley system that can be used with a minimal length of rope;

d. to provide a block and tackle pulley system that can be rigged from a single anchor point, and e. to provide a block and tackle pulley system that can be set-up very simply and quickly.

Still further objects and advantages will become apparent from a consideration of the ensuing description and drawings.

SUMMARY

In accordance with the present invention a pulley system comprises a stationary-block housing and a moving-block housing each having at least one pulley and a gripping means.

DRAWINGS

Drawing Figures

FIG. 1 shows an isometric view of one possible functional embodiment of the present invention.

FIG. 2 shows an isometric close-up view of the stationary-block housing.

FIG. 3 shows an isometric close-up view of the moving-block housing.

REFERENCE NUMERALS IN DRAWINGS

6 rope
8 load
10 stationary-block housing
12 moving-block housing
14 pulley
16 pulley
18 pulley
20 cam cleat
22 cam cleat
24 block attachment point

DETAILED DESCRIPTION

Description—FIGS. 1 to 3

A typical embodiment of the block and tackle pulley system of the present invention is illustrated in FIG. 1. The device has a pulley 14 and a pulley 18 which are attached to a stationary-block housing 10, having an attachment point 24. Attachment point 24 is connected to an immovable point, such as a crane, tripod, or affixed anchor. Affixed to stationary-block housing 10, is a cam cleat 22.

A pulley 16 and a cam cleat 20 are attached to a moving-block housing 12.

A rope 6 is attached to a load 8, and passed through cam cleat 20 and cam cleat 22, then through the system of pulleys 14, 16 & 18.

Cam cleat 20 allows rope to pass toward cam cleat 22, but grips the rope when it is pulled in the opposite direction, such as when load 8 is attached or when the rope 6 is pulled.

Cam cleat 22 allows rope to pass toward pulley 14, but grips the rope when it is pulled in the opposite direction, such as when load 8 is attached.

There are various possibilities to arranging the pulleys with respect to each other, their housings or the cam cleats. Additional pulleys may also be added to afford a greater mechanical advantage.

There are also various possibilities or variations on the use of the illustrated cam cleats 20 & 22. Double cleats which catch the rope against one another may also be used. Alternatively, the use of ratcheting pulleys which allow the rope to only pass in one direction may also be used.

Advantages

The advantages of the present invention arise from the combination of pulleys and rope gripping elements that allow the operator to reset the distance between the block and moving-block housings without allowing the load to slip.

From the description above, the advantage of my gripping block and tackle pulley system becomes evident:

a. The load may be a great distance from the fixed point, but the system allows the distance between the stationary-block and moving-block housings to be readjusted without allowing the load to slip. Thus by pulling on or feeding rope into the pulley system, the operator can move or lower a load with a limited amount of rope.

b. By limiting the amount of rope necessary, a tremendous space, weight, and cost savings can be realized without sacrificing any mechanical advantage.

c. The system can be mounted to a single point, and consists of two integral parts.

Operation—FIGS. 1–3

To move load 8, the operator pulls on rope 6 and as the rope 6 passes through pulleys 14, 16 & 18, cam cleat 20 grips the rope 6 and moves the load 8. As load 8 is moved, the rope 6 is passing through cam 22 towards pulley 14 and, moving-block housing 12 is moving toward stationary-block housing 10. When moving-block housing 12 touches or nears stationary-block housing 10, the operator releases rope 6 and cam cleat 22 grips the rope 6 and prevents load 8 from slipping.

At this point, the operator grasps moving-block housing 12 and moves it toward load 8, allowing the excess rope 6 feed back into pulleys 14, 16 & 18. As moving-block housing 12 moves toward load 8, cam cleat 20 allows rope 6 to pass. When the end of rope 6 nears pulley 18, or sufficient distance has been achieved between stationary-block housing 10 and moving-block housing 12, the operator can resume pulling on rope 6. By repeating these steps, the load 8 will move toward the attachment point 24. This is accomplished using only the amount of rope required to reach from the load 8 to the attachment point 24 plus what little rope is required to thread the system initially.

Alternatively, the present invention can be used to lower load 8. The operator allows rope 6 to feed toward pulley 18 and into the system while cam cleat 22 is being held open. When sufficient distance is achieved between the stationary-block housing 10 and moving-block housing 12, or the end of rope 6 nears pulley 18, then cam cleat 22 is reengaged. At this time, the cam cleat 20 is held open and the distance between the stationary-block housing 10 and moving-block housing 12 can be reduced by pulling on rope 6. By repeating the above steps, the load 8 can be lowered to a distance from stationary-block housing 10 equal to the length of rope 6 minus the small amount of rope required to remain threaded in the block and tackle system.

Summary, Ramifications, and Scope

Accordingly, the reader will see that the gripping block and tackle pulley system of this invention allows an operator to raise, move, or lower a load with a very limited amount of rope. This result will have a major impact upon many different load handling situations. All of the prior art in this area rely upon a block and tackle system where the moving block housing is directly attached to the load. This invention allows the moving block housing to be attached to the rope, which is then attached to the load. The result, that the load is moved, is the same, but with the present invention, this is accomplished with much less rope required. Additionally, this invention has the advantage of being able to be anchored to a single point, is very simply rigged, and is comprised of only two pieces of equipment (as opposed to an 'inchworm' or a piggy-backed z-pulley system.)

Although the description above contains many specificities, these should not be construed as limiting the scope of the invention but as merely providing illustrations of some of the presently preferred embodiments of this invention. Some examples of these variations are, but are not limited to:

a. the number of pulleys used may be increased or decreased, to increase or decrease the mechanical advantage achieved, b. the relative positions of the pulleys, attachment points, gripping mechanisms, and housings may be redesigned or reconfigured, c. the cam cleats used to grip the rope on the block and moving-block housing may be substituted with other mechanisms that perform a one-way gripping function on a rope (such as a double-cam cleats, prussic knots, ratchet pulleys, or deck cleats, etc.), d. string, cord, wire rope or cable, etc. may be substituted for rope, e. other mechanisms may be utilized that approximate the function of pulleys or sheaves, f. the system may be used upside-down or in a horizontal orientation, and g. the use of rotating side plates in the block housings may be utilized to allow the rope to escape the system once the load has been released.

Thus the scope of the invention should be determined by the appended claims and their legal equivalents, rather than by the examples given.

What is claimed is:

1. A block and tackle system comprising:

a. a stationary block housing having, in combination, at least one pulley or sheave-like element and means for gripping a rope such that said rope feeds unidirectionally through said pulleys, b. a moving block housing having, in combination, at least one pulley or sheave-like element and means for gripping a rope such that by raising the housing, a load attached to said rope is also raised, whereby the combination of said pulleys in both of the block housings afford a mechanical advantage in moving said load, and whereby the combination of gripping means hold said load without slippage, and whereby the combination of gripping means allow an operator to reset the distance between the block housings, thus moving said load with a limited amount of rope.

* * * * *